US009312050B2

(12) United States Patent
Yuan et al.

(10) Patent No.: US 9,312,050 B2
(45) Date of Patent: Apr. 12, 2016

(54) TINSEL WIRE

(71) Applicant: MERRY ELECTRONICS (SUZHOU) CO., LTD., Suzhou, Jiangsu Province (CN)

(72) Inventors: Yuan Yuan, Taichung (TW); Zhi-Yuan Li, Taichung (TW); Tse-Yu Liu, Taichung (TW)

(73) Assignee: Merry Electronics (Suzhou) Co., Ltd. (CN)

( * ) Notice: Subject to any disclaimer, the term of this patent is extended or adjusted under 35 U.S.C. 154(b) by 13 days.

(21) Appl. No.: 14/329,087

(22) Filed: Jul. 11, 2014

(65) Prior Publication Data

US 2016/0012939 A1 Jan. 14, 2016

(51) Int. Cl.
*H01B 5/12* (2006.01)
*H01B 1/04* (2006.01)

(52) U.S. Cl.
CPC ... *H01B 5/12* (2013.01); *H01B 1/04* (2013.01)

(58) Field of Classification Search
USPC ..... 174/126
See application file for complete search history.

(56) References Cited

U.S. PATENT DOCUMENTS

| | | | | | |
|---|---|---|---|---|---|
| 2,252,999 | A * | 8/1941 | Wallach | D02G 3/402 | 156/305 |
| 2,313,234 | A * | 3/1943 | Gavitt | H01B 7/0009 | 174/110 N |
| 3,572,344 | A * | 3/1971 | Bolduc | A61B 5/042 | 174/128.1 |
| 4,776,160 | A * | 10/1988 | Rees | D01H 1/10 | 57/210 |
| 2003/0183412 | A1* | 10/2003 | Kao | B32B 1/08 | 174/102 R |
| 2011/0005808 | A1* | 1/2011 | White | H01B 1/026 | 174/126.2 |

* cited by examiner

*Primary Examiner* — William H Mayo, III
*Assistant Examiner* — Krystal Robinson
(74) *Attorney, Agent, or Firm* — Bacon & Thomas, PLLC

(57) ABSTRACT

A tinsel wire is formed of a central fiber and at least one metallic lead wire combined with the central fiber. The central fiber is made of graphene.

10 Claims, 1 Drawing Sheet

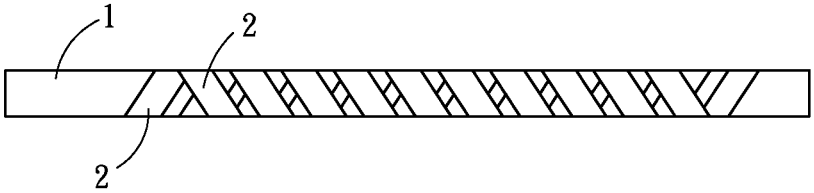
1
2
2

TINSEL WIRE

BACKGROUND OF THE INVENTION

1. Field of the Invention

The present invention relates generally to a graphene tinsel wire.

2. Description of the Related Art

A tinsel wire as known as lead wire is to connect a voice coil and a terminal and make electric current guided into the voice coil for signal transmission. The tinsel wire is made of a conductive material and a central fiber. The common central fiber includes cotton yarn, Nomex®, staple fiber, and nylon. However, the conventional tinsel wire is not preferable in electric conductivity, strength, and high-temperature resistance.

SUMMARY OF THE INVENTION

The primary objective of the present invention is to provide a tinsel wire which has enhanced conductibility, great strength, and resistance against high temperature.

To attain the above-mentioned objective, the technical solution adopted by the present invention is to provide a tinsel wire comprising a central fiber and at least one metallic lead wire combined with the central fiber. The central fiber is made of graphene.

Preferably, the central fiber is wrapped up in metallic lead wire.

Preferably, the surface of the tinsel wire is processed by copper coating, silver coating, or gold coating.

Preferably, the surface of the tinsel wire is processed by waxing.

Preferably, the diameter range of the graphene fiber is 10 μm-50 mm.

Preferably, the graphene fiber and the metallic lead wire are combined together by knitting.

Preferably, the graphene fiber and the metallic lead wire are combined together by cross weave.

Preferably, the graphene fiber and the metallic lead wire are combined together by knitting and cross weave both.

Preferably, the graphene fiber includes at least one single graphene fiber arranged in parallel along lengthwise.

Preferably, the graphene fiber includes at least one single graphene fiber arranged spirally along lengthwise.

Therefore, the tinsel wire of the present invention is of high electric conductivity, great strength, and resistance against high temperature. In addition, the metallic lead wire of the tinsel wire avoids the drawback that the graphene is not easily soldered, thus guaranteeing the soldering effect of the tinsel wire.

BRIEF DESCRIPTION OF THE DRAWINGS

FIG. 1 is a schematic view of a preferred embodiment of the present invention.

DETAILED DESCRIPTION OF PREFERRED EMBODIMENTS

Structural features and desired effects of the present invention will become more fully understood by reference to a preferred embodiment given hereunder. However, it is to be understood that the embodiment is given by way of illustration only, thus being not limitative of the claim scope of the present invention.

Referring to FIG. 1, a tinsel wire is formed of a graphene fiber 1 and a metallic lead wire 2 in combination with the graphene fiber 1. Two layers of the metallic lead wire 2 surround the surface of the graphene fiber 1. The graphene fiber 1 and the metallic lead wire 2 are combined together by cross weave.

Wherein, the metallic lead wire 2 is made of copper.

The surface of the tinsel wire is processed by copper coating and waxing.

The diameter range of the graphene fiber 1 is 10 μm-50 mm.

The graphene fiber 1 is formed of multiple graphene fibers arranged in parallel along lengthwise.

The graphene fiber 1 and the metallic lead wire 2 are combined together, so the tinsel fiber is of high electric conductivity, great strength, and resistance against high temperature. In addition, the metallic lead wire can avoid the drawback that the graphene fiber is not easily soldered, thus guaranteeing the soldering effect of the tinsel wire.

In addition, the graphene fiber 1 and the metallic lead wire 2 can also be combined with each other by knitting only or by cross weave and knitting both. Besides, the graphene fiber 1 can also be formed of multiple single graphene fibers arranged spirally along lengthwise. The metallic lead wire 2 can be one-layer or multi-layers.

What is claimed is:

1. A tinsel wire comprising a central fiber and at least one metallic lead wire combined with the central fiber, being characterized in that the central fiber is made of graphene.

2. The tinsel wire as defined in claim 1, being characterized in that one layer, two layers, or multiple layers of the metallic lead wire surround the surface of the graphene fiber.

3. The tinsel wire as defined in claim 1, being characterized in that the surface of the tinsel wire is processed by copper coating, silver coating, or gold coating.

4. The tinsel wire as defined in claim 3, wherein the surface of the tinsel wire is processed by waxing.

5. The tinsel wire as defined in claim 1, being characterized in that the graphene fiber is 10 μm-50 mm in diameter.

6. The tinsel wire as defined in claim 1, being characterized in that the graphene fiber and the metallic lead wire are combined with each other by knitting.

7. The tinsel wire as defined in claim 1, being characterized in that the graphene fiber and the metallic lead wire are combined with each other by cross weave.

8. The tinsel wire as defined in claim 1, being characterized in that the graphene fiber and the metallic lead wire are combined with each other by knitting and cross weave both.

9. The tinsel wire as defined in claim 1, being characterized in that the graphene fiber comprises at least one single graphene fiber arranged in parallel along lengthwise.

10. The tinsel wire as defined in claim 1, being characterized in that the graphene fiber comprises at least one single graphene fiber arranged spirally along lengthwise.

* * * * *